US006339978B1

(12) United States Patent
Hirse

(10) Patent No.: US 6,339,978 B1
(45) Date of Patent: Jan. 22, 2002

(54) OPEN END WRENCH

(75) Inventor: Gernot Hirse, Frankfurt am Main (DE)

(73) Assignee: Hirse-Patent-Lizénz-GmbH, Frankfurt am Main (DE)

( * ) Notice: Subject to any disclaimer, the term of this patent is extended or adjusted under 35 U.S.C. 154(b) by 0 days.

(21) Appl. No.: 09/530,261

(22) PCT Filed: Oct. 22, 1998

(86) PCT No.: PCT/EP98/06698

§ 371 Date: Jun. 28, 2000

§ 102(e) Date: Jun. 28, 2000

(87) PCT Pub. No.: WO99/21685

PCT Pub. Date: May 6, 1999

(30) Foreign Application Priority Data

Oct. 28, 1997 (DE) ..... 197 47 536

(51) Int. Cl.[7] ..... B25B 13/28
(52) U.S. Cl. ..... 81/99; 81/111
(58) Field of Search ..... 81/99, 111, 186

(56) References Cited

U.S. PATENT DOCUMENTS

| | | | | |
|---|---|---|---|---|
| 1,735,257 A | * | 11/1929 | Mead | 81/99 |
| 2,537,838 A | * | 1/1951 | Logan | 81/90.2 |
| 2,618,996 A | | 11/1952 | Logan | |
| 2,907,243 A | | 10/1959 | MacLean | |
| 4,276,790 A | | 7/1981 | Davis | |
| 4,584,913 A | | 4/1986 | Logan | |
| 4,616,534 A | | 10/1986 | Park et al. | 81/99 |
| 4,893,528 A | | 1/1990 | Chung-Hsing | |
| 5,287,777 A | | 2/1994 | Kolodziej | |

FOREIGN PATENT DOCUMENTS

| | | |
|---|---|---|
| CH | 365 348 | 12/1962 |
| DE | 32 12 312 | 10/1983 |
| DE | 196 12 751 | 10/1997 |

* cited by examiner

*Primary Examiner*—Joseph J. Hail, III
*Assistant Examiner*—David B. Thomas
(74) *Attorney, Agent, or Firm*—Burns, Doane, Swecker & Mathis, L.L.P.

(57) ABSTRACT

The invention relates to an open-end wrench having a clamping jaw which is rigidly connected to a wrench handle in a fixed manner. A spring-loaded, moveable clamping jaw is pivotally mounted on the fixed clamping jaw. A recess, which recoils opposite the plane of the clamping surface, is connected to the clamping surface of the fixed clamping jaw on the gripping side. The moveable clamping jaw has a recess located in the area between the clamping surface of the jaw and the pivot point thereof. In an opened state of the wrench, said recess approximately corresponds to the recess behind the fixed clamping jaw. The wrench can be handled similarly to a fixed open-end wrench, whereby it enables a ratcheting action and has a self-clamping operation.

10 Claims, 2 Drawing Sheets

OPEN END WRENCH

BACKGROUND OF THE INVENTION

The invention relates to an open-end wrench having a fixed clamping jaw that is rigidly connected to a wrench handle and a spring-loaded moveable clamping jaw whereby said moveable clamping jaw is pivotably mounted at a pivot point on the fixed clamping jaw and whereby said pivot point is disposed approximately at a right angle or at an angle of less than 90° behind the rear end of the clamping surface of the moveable clamping jaw.

One-piece open-end wrenches with two jaws, which are rigidly joined with one another, have the advantage, compared to wrenches having jaws that move relatively to one another, that sufficient torque may be transferred since the mouth of the wrench sufficiently embraces the workpiece, e.g. a bolt head or a nut. The access to the workpiece is ergonomically favorable especially since the wrench handle extends from the middle of the wrench head. The hand can therefore be moved forward up to the wrench head to guide the open-end wrench during placement (on the workpiece) by touch or to conduct a necessary manipulation of the workpiece, for example, to hold a nut that rotates easily. The open-end wrench may be slipped on or removed without hitting neighboring components.

However, rigid open-end wrenches have several disadvantages. For instance, the open-end wrench has to be pulled off and slipped on again after each turning sequence. If there is only a 30° movement possible for one turning sequence, then the open-end wrench has to be additionally turned around. This causes a considerable additional expenditure in time.

The widening of the wrench head caused by strain on the wrench head may lead to hazardous conditions. This applies particularly when the tolerances of the wrench width are added to the tolerances of the workpiece. Rigid open-end wrenches may be employed only for one nominal width and cannot be fitted to the tolerances of the workpiece. Rounded-off corners of the workpiece and misuse of nominal metric or widths in inches that are close in measurement lead also to the danger that the wrench may slip off the workpiece, which in turn leads to an increased risk of an accident. Even if a metric width or a width in inches is close, there are special rigid open-end wrenches necessary whereby the assortment of sizes is increased.

Since rigid open-end wrenches are not self-clamping, they can slip more easily in the direction of the rotating axis of the workpiece whereby the risk of an accident is increased as well. There is the lack of the possibility of adjustment to the dimensions of the workpiece, whereas it is made possible with a self-clamping action. There is also the lack of the possibility of adjustment to the operational process; for instance, the open-end wrench may not be left on the workpiece in a self-clamping position while intermediate operational steps are to be performed, or while working overhead.

The here referenced wrenches are to maintain the advantages of the open-end wrenches, avoid their disadvantages, and provide additional advantages. Particularly, it should be possible (but not absolutely necessary) to select a shape that is similar to a rigid open-end wrench. The wrench should be able to work in a ratcheting action in sequences of 30° and should be self-clamping.

Even though there are open-end wrenches known in many different configurations, none of them fulfill all the above-mentioned requirements.

Open-end wrenches with two moveable clamping jaws (U.S. Pat. No. 4,584,913) are of relatively complicated construction and are therefore costly to manufacture and they malfunction easily. In another version of an open-end wrench (CH-A 365 348) there occurs mutual locking of the two clamping jaws by swiveling the handle, which is connected to one of the clamping jaws by a joint. The construction is here also relatively complicated and therefore is malfunctions easily; manipulation requires a lot of space for the swiveling movement of the handle.

The guiding of the moveable clamping jaw on an arch (U.S. Pat. No. 5,287,777) causes very high demands in manufacturing and also causes malfunction through build-up of dirt and wear.

On a known wrench (U.S. Pat. No. 2,907,243), the moveable clamping jaw is moved longitudinally against the force of a spring on a guide, which is rigidly connected to the fixed clamping jaw. The necessary manufacturing demands are here also relatively high; the construction of the wrench causes a certain malfunctioning from build-up of dirt and/or wear. The wrench cannot be simply pulled off, gripping by hand is necessary near the bolt head to move the mobile jaws. This applies particularly also during the placement of the wrench (on the workpiece). Employment is therefore only possible when the wrench head is accessible.

This known wrench is not self-clamping since the moveable clamping jaw rests against a stop surface in its terminal position. The wrench does therefore not fulfill the requirement mentioned in the beginning.

Wrenches that have toothed clamping jaws (U.S. Pat. No. 4,616,534, DE-A 196 12 759) may be ratchet-operated in small increments because of the teeth; the engagement of teeth on the workpiece may, however, lead to damages so that these wrenches cannot be employed in the industrial area or on sensitive workpieces, for instance in the bolting operation in plumbing.

On a known wrench of the type mentioned in the beginning (U.S. Pat. No. 1,735,257), the clamping surface on the moveable clamping jaw, with which the clamping force is exerted onto the workpiece, is designed with a flat surface. The opposed clamping surface of the fixed clamping surface is convex arcuated. With this wrench, the bolting process may be performed only by ratcheting movements of 60°.

It is therefore the object of the invention to design an open-end wrench of the type mentioned in the beginning that has essentially the function of a rigid open-end wrench but which is self-clamping, and which makes possible ratchet movements of 30° whereby the necessary swiveling movement of the wrench handle does not substantially amount to more than 30° itself.

It is therefore the object of the invention to design an open-end wrench of the type mentioned in the beginning that has essentially the function of a rigid open-end wrench but which is self-clamping and which makes possible ratchet movements of 30° whereby the necessary swiveling movement of the wrench handle itself does not substantially amount to more than 30°.

SUMMARY OF THE INVENTION

This object is achieved according to the invention in that each clamping surface is subdivided by at least two convex arcuated clamping teeth; that a recess, which recoils opposite the plane of the clamping surface, is connected on the side of the handle to the clamping surface of the fixed jaw, and that the moveable clamping jaw is provided with a recess in the area behind the clamping surface and the pivot point and which recess approximately corresponds to the recess behind the fixed clamping jaw in the open position of the wrench.

As a result of its self-clamping function, the wrench adjusts itself to the dimensions of the workpiece so that especially the deviation derived from the tolerance is compensated and does not lead to the danger of slipping. The widening of the mouth of the wrench is also compensated by the self-clamping effect and this does not lead therefore to possible slipping. Only one single wrench is necessary for nominal widths in the metric and inch-system whereby the amount of the required wrench assortment is decreased.

The self-clamping effect makes also possible to leave the wrench on the workpiece in a self-clamping manner if said wrench has to be released because of a necessary intermediate operational step. The wrench does also not fall down when released during work overhead.

The wrench may be ratchet-operated in increments of 30° so that it does not have to be pulled off and slipped on anew. The time in handling is thereby decreased considerably.

Only by the provided recess behind the clamping surfaces of the two clamping jaws has it been made possible to manipulate the self-clamping wrench in a ratcheting movement since only through these recesses enough space has been created to move the wrench back over the workpiece only with minute widening of the wrench mouth. The swiveling motion of the wrench handle, as performed during ratcheting action of approximately 30°, is only a little more than 30°. The wrench can therefore be employed also under very tight working conditions. Nevertheless, the wrench has substantially the shape and dimensions of a rigid open-end wrench and may be handled just as simple.

According to one embodiment of the invention it is proposed that the moveable clamping jaw protrude with one joint eye into the longitudinal slot that runs from the fixed clamping jaw into the wrench handle. Thereby the parts moving relatively to one another are arranged in a way to be protected so that there is achieved a smooth and compact design of the wrench. The spring, which communicates with the moveable clamping jaw, is preferably a tension spring that is braced against the wrench handle and which pushes the moveable clamping jaw in the direction of its clamping position. This tension spring is preferably a leaf spring attached to the wrench handle whereby said spring is mainly arranged in the longitudinal slot and whereby it does not interfere with the handling of the wrench and cannot be damaged.

If the center segment of the leaf spring does protrude from the longitudinal slot in the open position of the wrench, then the moveable clamping jaw can be moved by applying pressure on this center segment.

According to a preferred embodiment of the invention, it is proposed that the moveable clamping jaw is provided with a stop surface that is angled relative to the clamping surface and which connects to the clamping surface on the handle side. This stop surface prevents that the wrench embraces the workpiece too far when slipped on and after each ratcheting action.

BRIEF DESCRIPTION OF THE DRAWINGS

Embodiment examples of the invention are described in more detail below, which are also illustrated in the drawings.

DETAILED DESCRIPTION OF PREFERRED EMBODIMENTS OF THE INVENTION

Figure 1:
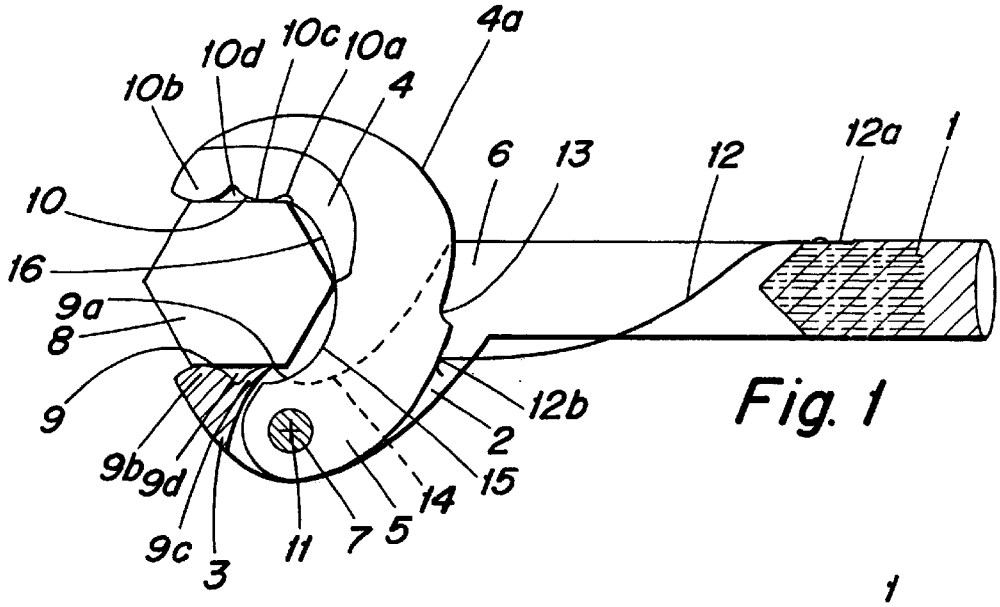
FIG. 1 shows a wrench in a longitudinal view in a first clamping position.
Figure 2:
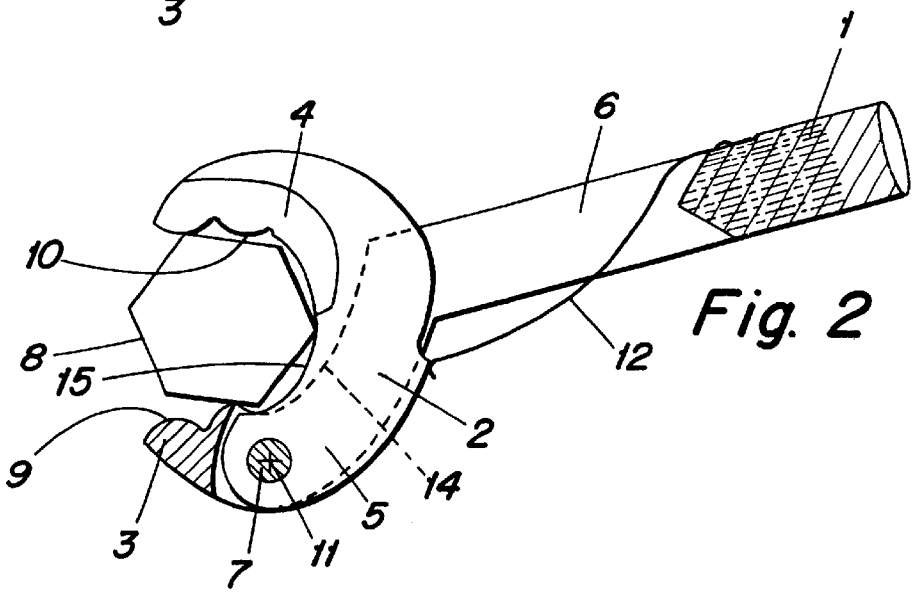
FIG. 2 shows the wrench according to FIG. 1 in an intermediate position during the ratcheting action.
Figure 3:
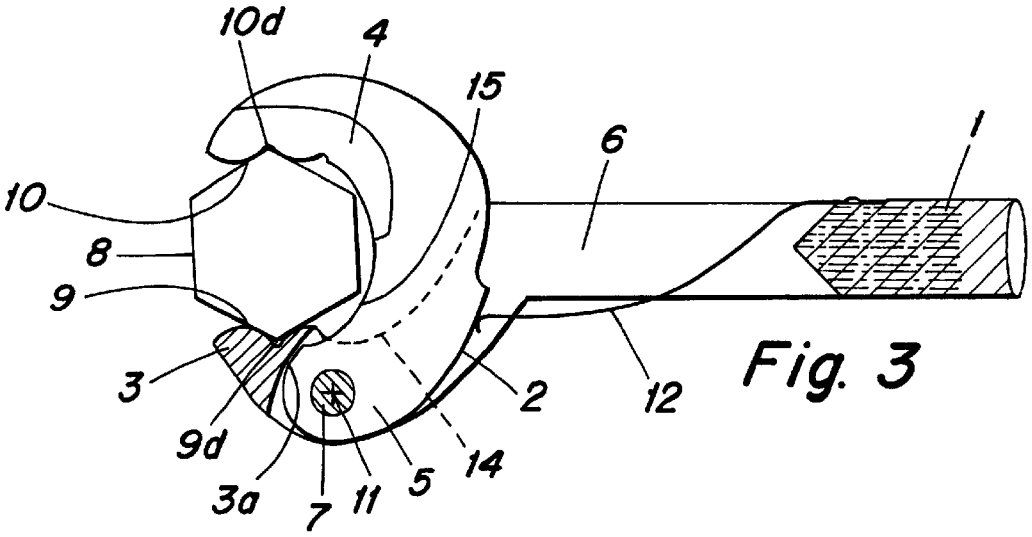
FIG. 3 shows the wrench according to FIG. 1 and FIG. 2 in a second clamping position being 30° displaced relative to FIG. 1.

The wrench illustrated in FIG. 1 through FIG. 3, which is similar in its outer dimension and in handling to an open-end wrench, is provided with a wrench handle 1 that is connected to a fixed clamping jaw 3 via a right-angled transition piece 2. A moveable clamping jaw 4 protrudes with a joint eye 5 into a longitudinal slot 6, which runs from the fixed clamping jaw 3 into the wrench handle 1. A pivot pin 7 forms the pivot bearing for the moveable clamping jaw 4.

Figure 6:
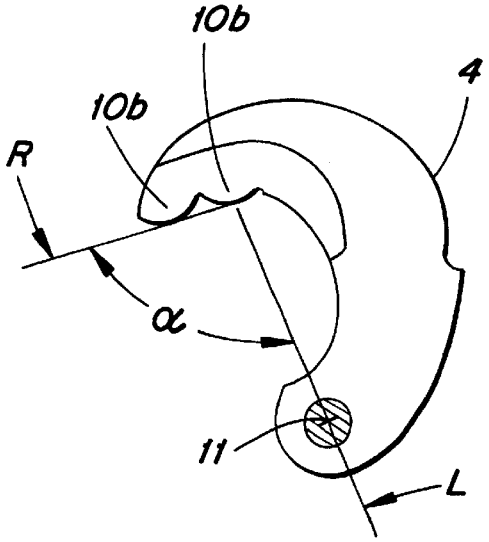
FIG. 6 shows a relationship between the clamping surface and the pivot point of the moveable jaw of the wrench.

A workpiece 8 that is received in a wrench, for example a hexagon bolt head, lies in the horizontal clamping plane 9 of the fixed clamping jaw 3 and the horizontal clamping plane 10 of the moveable clamping jaw 4. The pivot point 11 of the pivotable clamping jaw 4, which is determined by the pin 7 and which can be seen in FIG. 1, lies approximately in a right angle at the rear end 10*a* of the clamping surface 10 of the moveable clamping jaw 4. The angle may also be smaller. Stated another way, the peaks of the front and rear teeth 10*b* lie on a reference line R which terminates at a termination point disposed at a peak of the rear tooth 10*b;* an imaginary line L extending from that termination point to the pivot point 11 forms an angle $\alpha$ not greater than about ninety degrees with the reference line, as shown in FIG. 6.

Both clamping surfaces 9 and 10 are formed by two convex arcuated clamping teeth 9*b* or 10*b,* which are separated from one another by a notch 9*d* or 10*d.* The flanks of the notches 9*d* and 10*d* of the clamping surface 9 or 10 are disposed in an angle of less than 120° to one another. This leads to the fact that in the second clamping position shown in FIG. 3, the corners are not gripped but the neighboring, connecting surface segments of the workpiece 8 are gripped by the clamping surfaces 9 and 10. The pressure on the corners of the workpiece is thereby removed and the danger of slipping is avoided.

A leaf spring 12 is attached to the wrench handle 1 with its one end 12*a* and extends into the longitudinal slot 6. The other rounded-off, free end 12*b* of the leaf spring 12 rests against the rear side 4*a* of the moveable clamping jaw 4 and pushes it into its clamping position. On the rear side 4*a* of the moveable clamping jaw 4 there may be provided a locking recess 13 into which the free end 12*b* of the leaf spring 12 comes to rest to keep the moveable clamping jaw 4 in its open position for removal.

On the clamping surface 9 of the fixed clamping jaw 3 there is a recess 14 that is connected at its rear end 9*a* on the handle side whereby said recess 14 recoils relative to the plane of the clamping surface 9. The moveable clamping jaw 4 is also provided with a recess 15 in the area between the clamping surface 10 and the pivot point 11, which approximately corresponds to the recess 14 behind the fixed clamping jaw 3 in the open position of the wrench (FIG. 2).

These two recesses 14 and 15 provide a space for the workpiece 8 during the ratcheting action (FIG. 2) whereby the moveable clamping jaw 4 does not have to be opened too far. This makes possible to spread out the part of the moveable clamping jaw 4 that extends over the entire wrench width in a relatively widespread fashion in the direction toward the pivot point 11. Thereby the right-angled segment 2 does not interfere with the movement of the moveable clamping jaw 4. The moveable clamping jaw 4 is therefore provided with a stop surface 16 on the handle side that is angled relative to the clamping surface 10 and which is connected to said clamping surface 10 whereby said stop surface serves as a guide for the wrench on the workpiece 8 as can be clearly seen in FIG. 3, for example.

During the ratcheting action, the wrench is pivoted relative to the workpiece until the corners of the workpiece 8 enter the notches 9*d* or 10*d* (FIG. 2 shows an intermediate position during pivoting). In the second clamping position, as illustrated in FIG. 3, the workpiece 8 is rotated anew with the wrench by an additional rotating sequence of 30°, for example.

Figure 4:
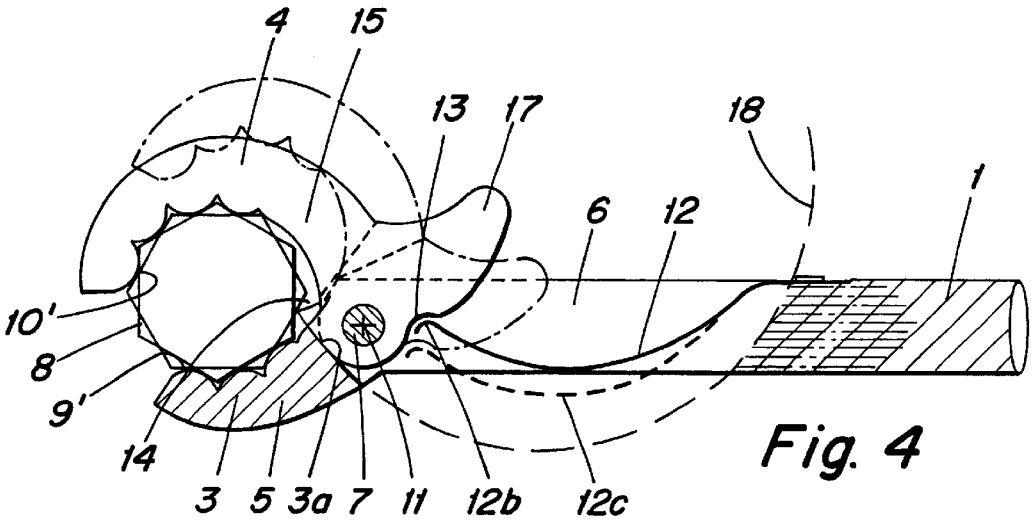
FIG. 4 shows a modified embodiment of the wrench similar to a ⅚-ring wrench.

While in the embodiment examples in FIG. 1 through FIG. 3 the wrench handle 1 extends substantially in the opposite direction of the mouth opening of the wrench, the handle in the embodiment example in FIG. 4 forms an angle of approximately 30° relative to the mouth opening. The pivot point 11 for the pivoting movement of the moveable clamping jaw 4 is hereby displaced near the longitudinal axis of the handle 1, whereas it is displaced laterally relative to this longitudinal axis in the example in FIG. 1 through FIG. 3. The wrench in FIG. 4 has thereby approximately the outer shape of a so-called ⅚-ring wrench. The clamping surface 9' or 10' of the fixed clamping jaw 3 or of the moveable clamping jaw 4 are hereby formed by a plurality of convex rounded clamping teeth, which are disposed on an arch.

The moveable clamping jaw 4 is hereby connected to an actuating protrusion 17, which extends toward the wrench handle 1, and which makes possible to open the wrench against the force of the leaf spring 12.

Such wrenches are especially advantageous for the use on hydraulic lines, e.g. brake lines, or for threaded rods. Self-clamping action is here of particular importance—especially to avoid slipping sidewise.

As shown in FIG. 4 by dashes, the center segment 12*c* of the leaf spring 12 bows outside the longitudinal slot 6 in the open position of the wrench (the moveable clamping jaw 4 is illustrated by dots and dashes). After locking of the free end 12*b* of the leaf spring 12 in the locking recess 13, the moveable clamping jaw can be again pivoted into its operational position whereby one pushed with his thumb on the arcuated center segment 12*c*. This configuration of the wrench in FIG. 4 is especially favorable under ergonomic view points since the hand gripping the wrench handle 1 can actuate with its index finger the protrusion 17 and can actuate with its thumb the center segment 12*c* of the leaf spring 12.

In FIG. 4 there is indicated by an arch 18 in dashes that the longitudinal slot 6 may be produced in a single, simple cutting process by using a disk milling cutter.

Figure 5:
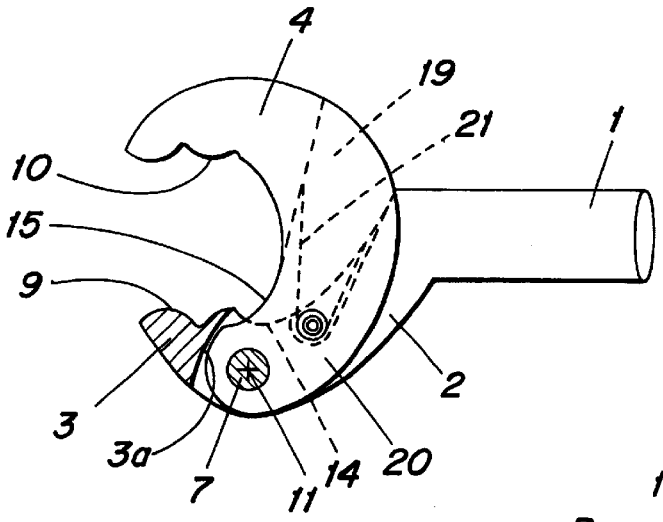
FIG. 5 shows an additional modified embodiment of the wrench.

The embodiment example in FIG. 5 differs from the example in FIG. 1 through FIG. 3 substantially in that the moveable clamping jaw 4 is provided with two joint cheeks 20, which are separated from one another by a slot 19, whereby said joint cheeks embrace the right-angled segment 2 on both sides and receive it in between. A leg spring 21 is arranged between the two joint cheeks 20 and it is braced against the wrench handle 1 on one side and on the rear side of the moveable clamping jaw 4 on the other side. The leg spring 21 is thereby completely covered within the wrench head. The slot to be cut out between the two joint cheeks 20 is easier to be manufactured than the longitudinal slot 6 of the previously described embodiment examples. The workpiece is embraced with all surfaces in this embodiment. A stop surface 3*a* of the fixed clamping jaw 3 on the handle side limits the possible rotating movement of the moveable clamping jaw 4 and determines thereby the fully closed position of the wrench.

All illustrated embodiments have in common that the fixed clamping jaw 3 is not cut out in the center but it makes contact against the workpiece 8 with its entire surface. The version of the clamping surfaces 9 and 9', 10 and 10' with their convex arcuated clamping teeth contribute additionally that during the ratcheting action less friction is exerted on the workpiece 8. This may be of significance especially in the use on sensitive workpieces, for instance during plumbing installation.

What is claimed is:

1. An open-ended wrench comprising:

a wrench handle;

a fixed clamping jaw rigidly connected to the handle; and a spring-loaded movable clamping jaw pivotably mounted to the fixed jaw at a pivot point;

the fixed jaw including a fixed clamping surface, and the movable clamping jaw including a movable clamping surface disposed generally opposite the fixed clamping surface, the fixed and movable clamping surfaces together forming a cavity for receiving a workpiece;

the fixed clamping surface including a plurality of convexly curved fixed clamping teeth, wherein adjacently disposed ones of the fixed teeth are separated by a notch, the plurality of fixed teeth including a pair of front and rear convexly curved fixed clamping teeth disposed adjacent a mouth of the cavity and oriented such that peaks of the front and rear fixed teeth together define a fixed clamping surface, the front fixed clamping tooth being disposed closer to the mouth than is the rear fixed clamping tooth;

the movable clamping surface including a plurality of convexly curved movable clamping teeth, wherein adjacently disposed ones of the movable teeth are separated by a notch, the plurality of movable teeth including a pair of convexly curved front and rear movable clamping teeth disposed adjacent the mouth of the cavity and oriented such that peaks of the front and rear movable teeth lie on a reference line which terminates at a termination point disposed at a peak of the rear movable tooth, an imaginary line extending from that termination point to the pivot point forms an angle not greater than about ninety degrees with the movable clamping surface;

the movable jaw including a concavely curved recess extending from a rear end of the rearwardmost one of the plurality of movable teeth to a location adjacent the pivot point.

2. A wrench according to claim 1, wherein the movable jaw is disposed within a longitudinal slot formed in the fixed jaw and the wrench handle.

3. A wrench according to claim 2, wherein a spring which is braced against the wrench handle, pushes the movable jaw toward a clamping position.

4. A wrench according to claim 3, wherein the spring comprises a leaf spring attached to the wrench handle and arranged mainly in the longitudinal slot.

5. A wrench according to claim 4, wherein a center segment of the leaf spring bows out from the longitudinal slot in an open position of the wrench.

6. A wrench according to claim 1, wherein the movable jaw is provided with a stop surface on the handle side that is angled relative to the movable clamping surface and which is connected to the movable clamping surface.

7. A wrench according to claim 1, wherein each notch includes flanks disposed at an angle of less than 120 degrees to one another.

8. A wrench according to claim 1, wherein the movable jaw comprises two joint cheeks separated by a slot.

9. A wrench according to claim 8, wherein a leg spring is arranged between the joint cheeks and is braced against the movable jaw.

10. A wrench according to claim 1, wherein the movable jaw includes a stop surface engageable with the fixed jaw for defining a fully closed position of the movable jaw.

* * * * *